US011095066B2

(12) United States Patent
Sawazaki

(10) Patent No.: US 11,095,066 B2
(45) Date of Patent: Aug. 17, 2021

(54) ELECTRICAL APPARATUS

(71) Applicant: TOYOTA JIDOSHA KABUSHIKI KAISHA, Toyota (JP)

(72) Inventor: Keisuke Sawazaki, Nisshin (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 16/798,937

(22) Filed: Feb. 24, 2020

(65) Prior Publication Data

US 2020/0328552 A1 Oct. 15, 2020

(30) Foreign Application Priority Data

Apr. 10, 2019 (JP) ..... JP2019-075058

(51) Int. Cl.
*H01R 13/6593* (2011.01)
*H01R 13/512* (2006.01)
*H01R 13/6591* (2011.01)

(52) U.S. Cl.
CPC ..... *H01R 13/512* (2013.01); *H01R 13/6593* (2013.01); *H01R 13/65912* (2020.08); *H01R 2201/26* (2013.01)

(58) Field of Classification Search
None
See application file for complete search history.

(56) References Cited

U.S. PATENT DOCUMENTS 5,752,855 A * 5/1998 Mehez ..... H01R 13/719 439/607.47
8,109,779 B2 * 2/2012 Wu ..... H01R 13/65912 439/353
10,103,498 B2 * 10/2018 Maesoba ..... H01R 13/516

FOREIGN PATENT DOCUMENTS

JP 2013-090366 A 5/2013
JP 2018-111420 A 7/2018

* cited by examiner

*Primary Examiner* — Felix O Figueroa
(74) *Attorney, Agent, or Firm* — Oliff PLC

(57) ABSTRACT

An electrical apparatus may include: a housing accommodating an electrical device; and a connector connected to an outer surface of the housing, in which the connector includes: a connector body including a terminal electrically connected to the electrical device; an upper shell covering a back surface of the connector body; a lower shell fixed to a lower portion of the connector body and to which a shield tube surrounding a cable connected to the terminal is fixed; and a guard plate fixed to the lower shell and extending between the upper shell and the connector body.

3 Claims, 5 Drawing Sheets

ELECTRICAL APPARATUS

CROSS-REFERENCE TO RELATED APPLICATION

This application claims priority to Japanese Patent Application No. 2019-075058, filed on Apr. 10, 2019, the entire contents of which are incorporated herein by reference.

TECHNICAL FIELD

The disclosure herein relates to an electrical apparatus. In particular, the present disclosure relates to an electrical apparatus having a connector connected to an outer surface of the electrical apparatus.

BACKGROUND

There is a case where connector(s) are connected to an outer surface of a housing of an electrical apparatus. For example, Japanese Patent Application Publication No. 2018-111420 (Document 1) and Japanese Patent Application Publication No. 2013-090366 (Document 2) respectively describe an electrical apparatus to which a connector is connected. When an electrical apparatus is arranged in a space in which various devices are accommodated, such as in a front compartment of a vehicle, a connector may be damaged by collisions with those other devices. Damage to the connector can cause loss of a function in the electrical apparatus. The connector is provided with an electrical conductor which is in conduction with electrical device(s) constituting the electrical apparatus. If the connector is damaged, there is a risk that the electrical conductor to which a high voltage (voltage exceeding 100 volts) is being applied may be exposed.

Document 1 describes an electrical apparatus (power converter) mounted in a front compartment of a vehicle. A brake actuator is disposed on a rear side of the power converter. In the power converter of Document 1, the connector is provided on a rear surface facing the rear side of the vehicle, and protectors extending further rearwardly than the connector are provided on both sides of the connector. When the power converter is pushed backward upon a collision, the protectors come into contact with the brake actuator before the connector comes into contact with the brake actuator and the protectors push the brake actuator rearward. As a result, the connector is prevented from coming into contact with the device. The electrical apparatus (power converter) of Document 2 is provided with a space for accommodating the connector in its housing. The connector can be protected by increasing a thickness of a wall of the accommodating space.

SUMMARY

In the technique described in Document 1, the protectors must be disposed on both sides of the connector, and a space for the protectors is required. The technique of Document 2 requires a space for the connector accommodating space. The present specification discloses a robust connector that does not require a space for damage prevention. Also disclosed is an electrical device to which the connector is connected.

An electrical apparatus disclosed herein may comprise: a housing accommodating an electrical device; and a connector connected to an outer surface of the housing, wherein the connector comprises: a connector body including a terminal electrically connected to the electrical device; an upper shell covering a back surface of the connector body; a lower shell fixed to a lower portion of the connector body and to which a shield tube surrounding a cable connected to the terminal is fixed; and a guard plate fixed to the lower shell and extending between the upper shell and the connector body.

In the technique disclosed herein, the guard plate is extended from the lower shell to protect the connector body. Since the guard plate is provided inside the upper shell, wasteful space is not required outside the connector.

The upper shell protecting the back surface of the connector body may be made of resin or aluminum. The lower shell to which the shield tube is connected may be made of metal to provide electrical continuity with the shield tube. The lower shell may be made of a metal having a higher strength than the upper shell. When the guard plate made of the metal having such high strength is disposed inside the upper shell, the connector body can be strongly protected.

The guard plate may be fixed only to the lower shell. In particular, the guard plate may be cantilevered by the lower shell. That is, un upper end of the guard plate may be a free end. When the upper end of the guard plate is the free end, the guard plate can be deflected when another device collides with the connector, and impact of the collision can be mitigated.

Details and further improvements of the technique disclosed herein are described in "DETAILED DESCRIPTION" below.

DETAILED DESCRIPTION

Embodiment

Figure 1:
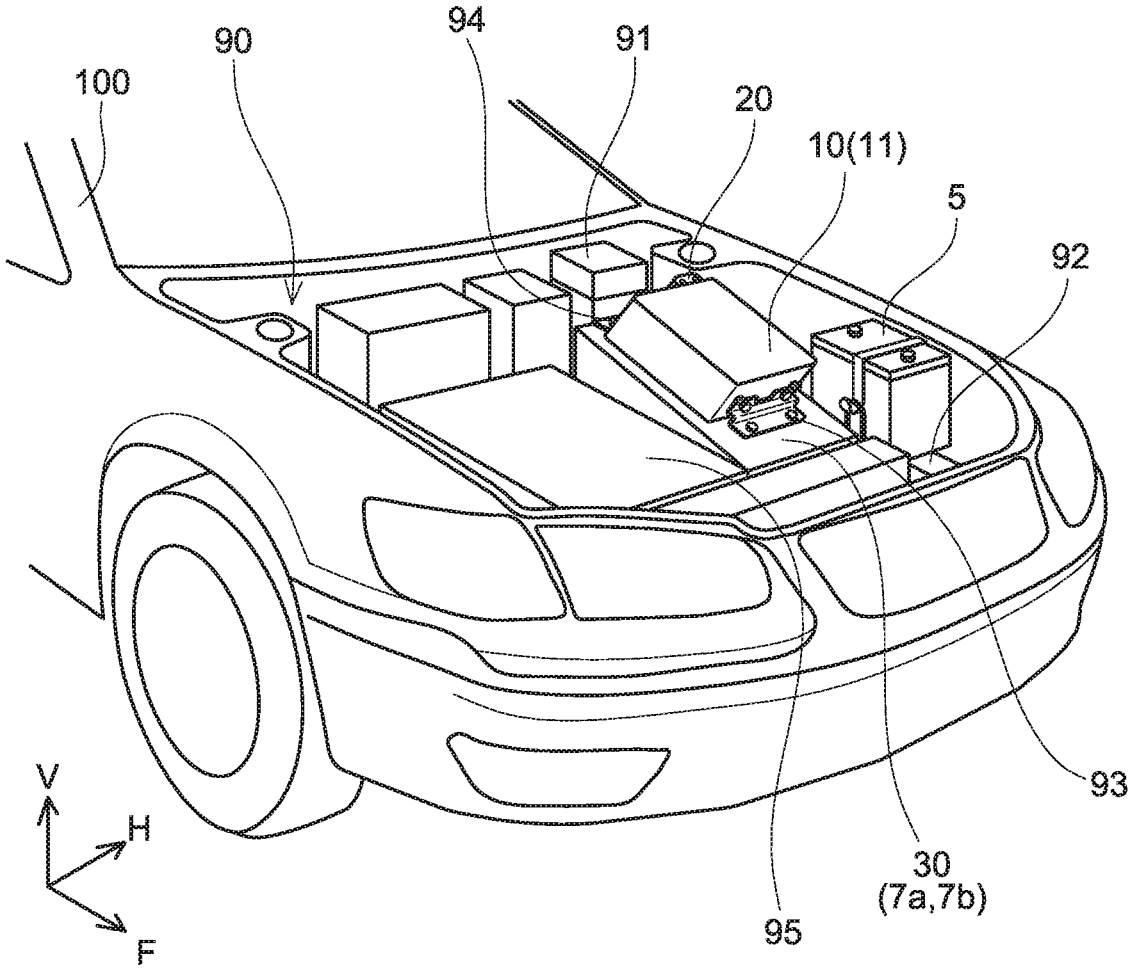
FIG. 1 is a perspective view of a front compartment of a hybrid vehicle equipped with a power converter according to an embodiment.

An electrical apparatus according to an embodiment will be described with reference to figures. The electrical apparatus of the embodiment is a power converter 10 mounted on a hybrid vehicle. The power converter 10 is an apparatus configured to convert electric power of a main battery (not shown) into electric power for driving a traction motor. FIG. 1 is a perspective view showing a device layout in a front compartment 90 of a hybrid vehicle 100. In a coordinate system shown in the figures, a positive direction of a F-axis indicates a front side of the vehicle, a positive direction of a V-axis indicates an upper side of the vehicle, and a positive direction of a H-axis indicates a left side of the vehicle. In FIG. 1, devices mounted in the front compartment 90 are schematically illustrated.

The front compartment 90 houses an engine 95, a transaxle 30, the power converter 10, an accessory battery 5, and a brake actuator 91 therein. Various other devices are housed in the front compartment 90, but illustration and description thereof are omitted.

The hybrid vehicle 100 includes three traction motors and the engine 95 for running. Of the three motors, two motors 7*a*, 7*b* are housed in a housing of the transaxle 30 to drive front wheels. The remaining motor (rear motor) is located at the rear part of the vehicle and configured to drive rear wheels. The engine 95 and the transaxle 30 are connected so as to be adjacent to each other in a vehicle width direction. The engine 95 and the transaxle 30 are bridged between two side members 92 that secure a structural strength of the vehicle. In FIG. 1, one side member is not visible.

The power converter 10 is fixed to an upper surface of the transaxle 30. The power converter 10 is supported on the transaxle 30 via a front bracket 93 and a rear bracket 94. The power converter 10 is an apparatus configured to boost DC power of the main battery and convert the boosted DC power into AC power suitable for driving the traction motors. A connector 20 for the rear motor is connected to a rear surface of a housing 11 of the power converter 10. The brake actuator 91 is disposed on the rear side of the power converter 10 (rear side of the connector 20).

Figure 2:
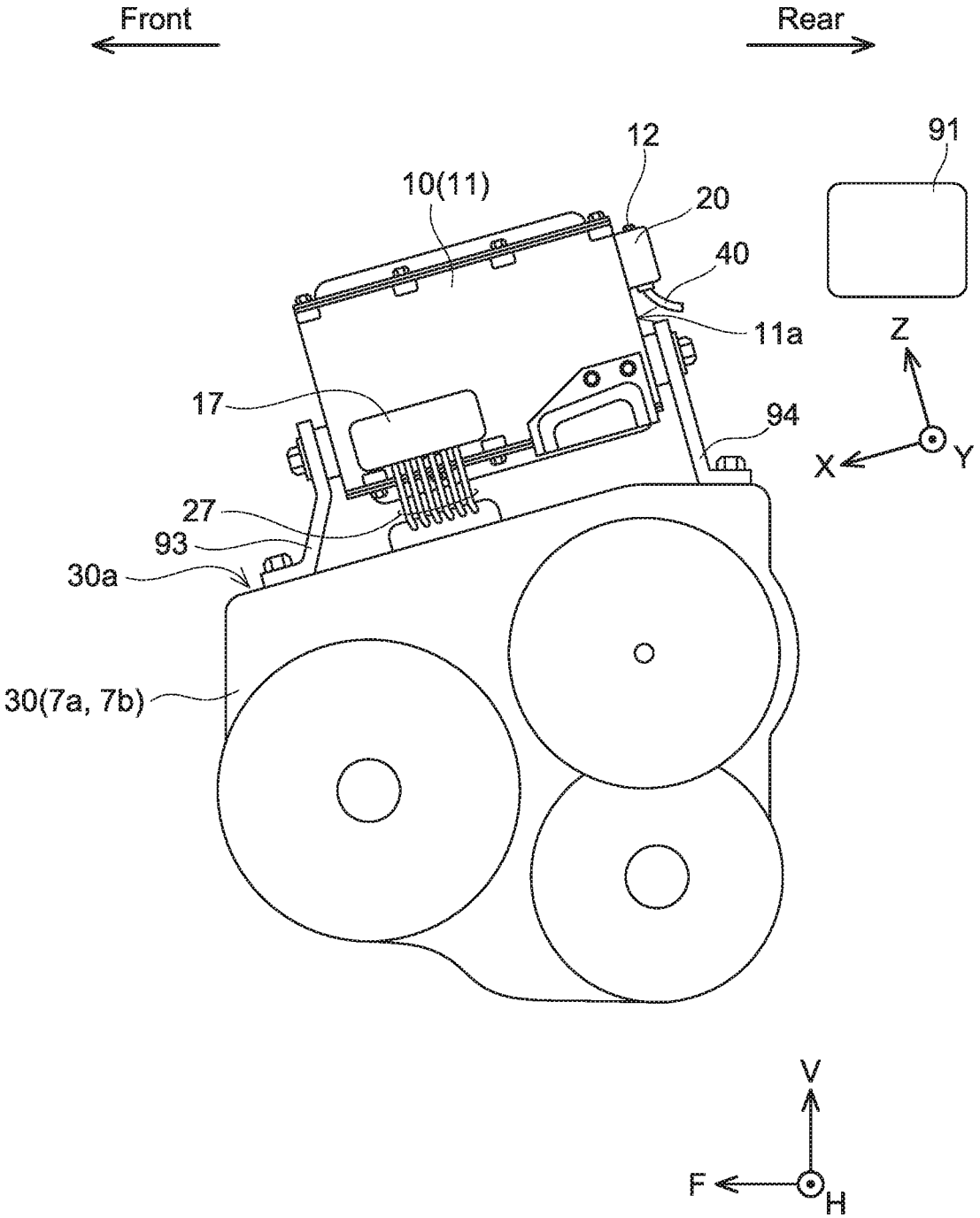
FIG. 2 is a side view of the power converter and its surroundings.
Figure 3:
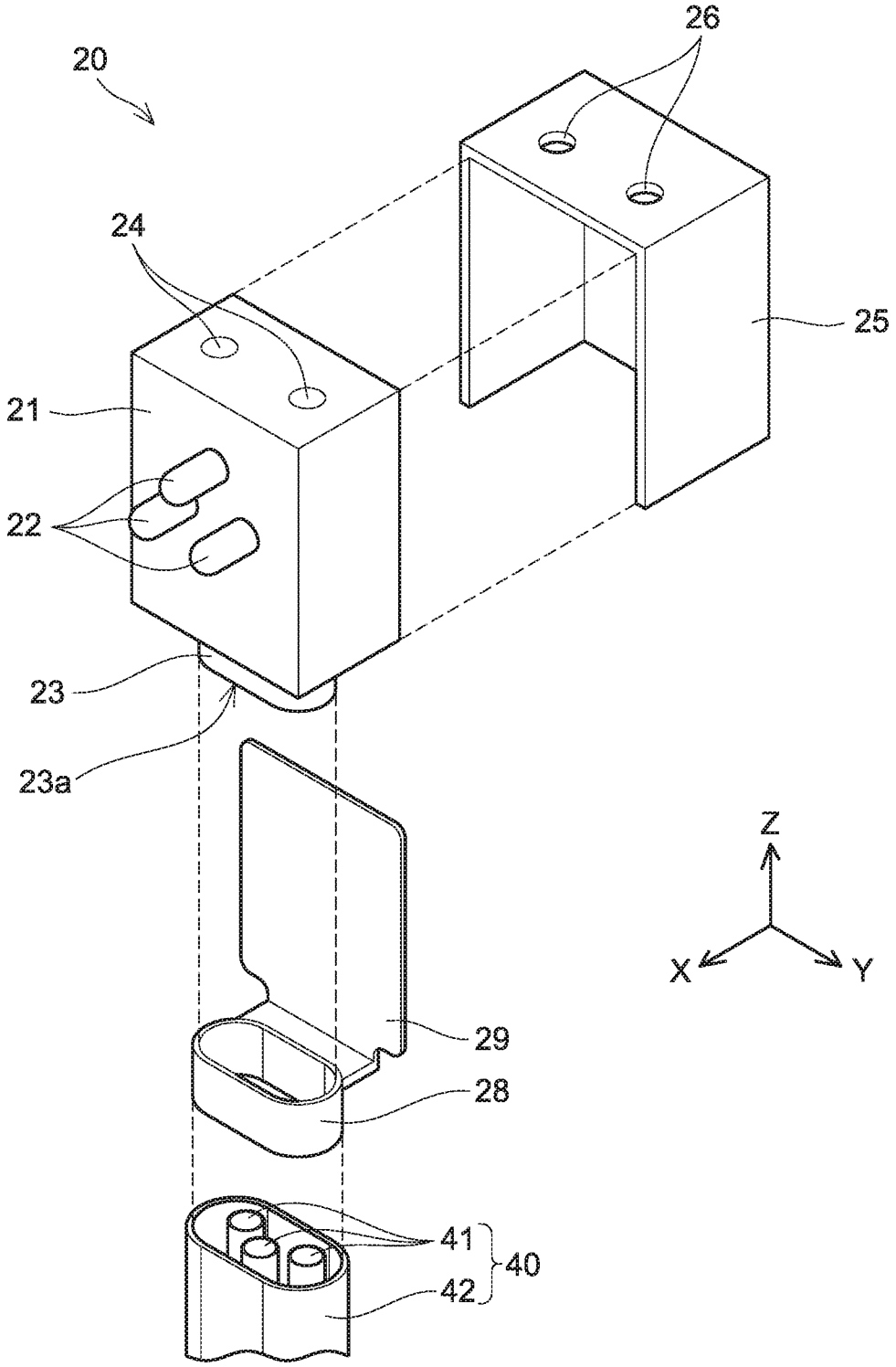
FIG. 3 is an exploded perspective view of a connector.

FIG. 2 is a side view of the power converter 10 and its surroundings. FIG. 2 also shows the brake actuator 91. The brake actuator 91 is supported by a dash panel (not shown). In FIG. 2, the positive direction of the F-axis in the coordinate system represents the front side of the vehicle, and the positive direction of the V-axis represents the upper side. The positive direction of the H axis indicates the left side of the vehicle. XYZ coordinate systems of FIGS. 2 and 3 are coordinate systems with the housing 11 of the power converter 10 being a reference, in which an X-axis extends in a direction parallel to a bottom surface of the housing 11 and a Z-axis extends in a direction parallel to a rear surface 11*a* of the housing 11.

As described above, the power converter 10 is supported on an upper surface 30*a* of the transaxle 30 via the front bracket 93 and the rear bracket 94. A connector 17 is connected to a left side surface of the housing 11. Six power cables extend from the connector 17 and are connected to the motors 7*a*, 7*b* inside the transaxle 30. The motors 7*a* and 7*b* are three-phase AC motors, and the six power cables supply two sets of three-phase AC power from the power converter 10 to the motors 7*a* and 7*b* (power receiving apparatuses).

The connector 20 is connected to the rear surface 11*a* of the housing 11 of the power converter 10. The rear surface 11*a* corresponds to a side surface facing the rear side of the vehicle. The connector 20 is fixed to the housing 11 (rear surface 11*a*) by bolts 12. A wire harness 40 is connected to a lower end of the connector 20. The wire harness 40 is connected to the rear motor mounted on the rear part of the vehicle. As described later, the wire harness 40 is composed of power cables for transmitting electric power and a shield tube surrounding the power cables. The wire harness 40 (power cables) supplies three-phase AC power from the power converter 10 to the rear motor.

As described above, the power converter 10 is supported by the front bracket 93 and the rear bracket 94 with a gap between the power converter 10 and the upper surface 30*a* of the transaxle 30. When the vehicle collides at its front part, a collision load is applied to the housing 11 of the power converter 10 from its front side. When such collision load is applied, the front bracket 93 and the rear bracket 94 are deformed or broken, and the power converter 10 is retracted. The brake actuator 91 is disposed on the rear side of the power converter 10, and if the power converter 10 is retracted, the connector 20 may come into contact with the brake actuator 91. Contact with the brake actuator 91 may damage the connector 20. The drive voltage of the rear motor may exceed 100 volts, and a voltage exceeding 100 volts is being applied to the electrical conductor inside the connector 20 and the power cables in the wire harness 40. It is not preferable that the connector 20 is damaged and the conductor to which the high voltage is applied is exposed. The connector 20 has a robust structure so as to withstand the collision load.

A detailed structure of the connector 20 will be described. FIG. 3 is an exploded perspective view of the connector 20. The connector 20 comprises a connector body 21, an upper shell 25, a lower shell 28, and a guard plate 29. The wire harness 40 is connected to a lower part 23 of the connector 20. The wire harness 40 includes three power cables 41 (each of those peripheral surfaces is covered with an insulator) configured to transmit high voltage three-phase alternating current, and a shield tube 42 surrounding the three power cables 41. The shield tube 42 is made of a braided wire and shuts off radio noise emitted by the power cables 41.

Figure 4:
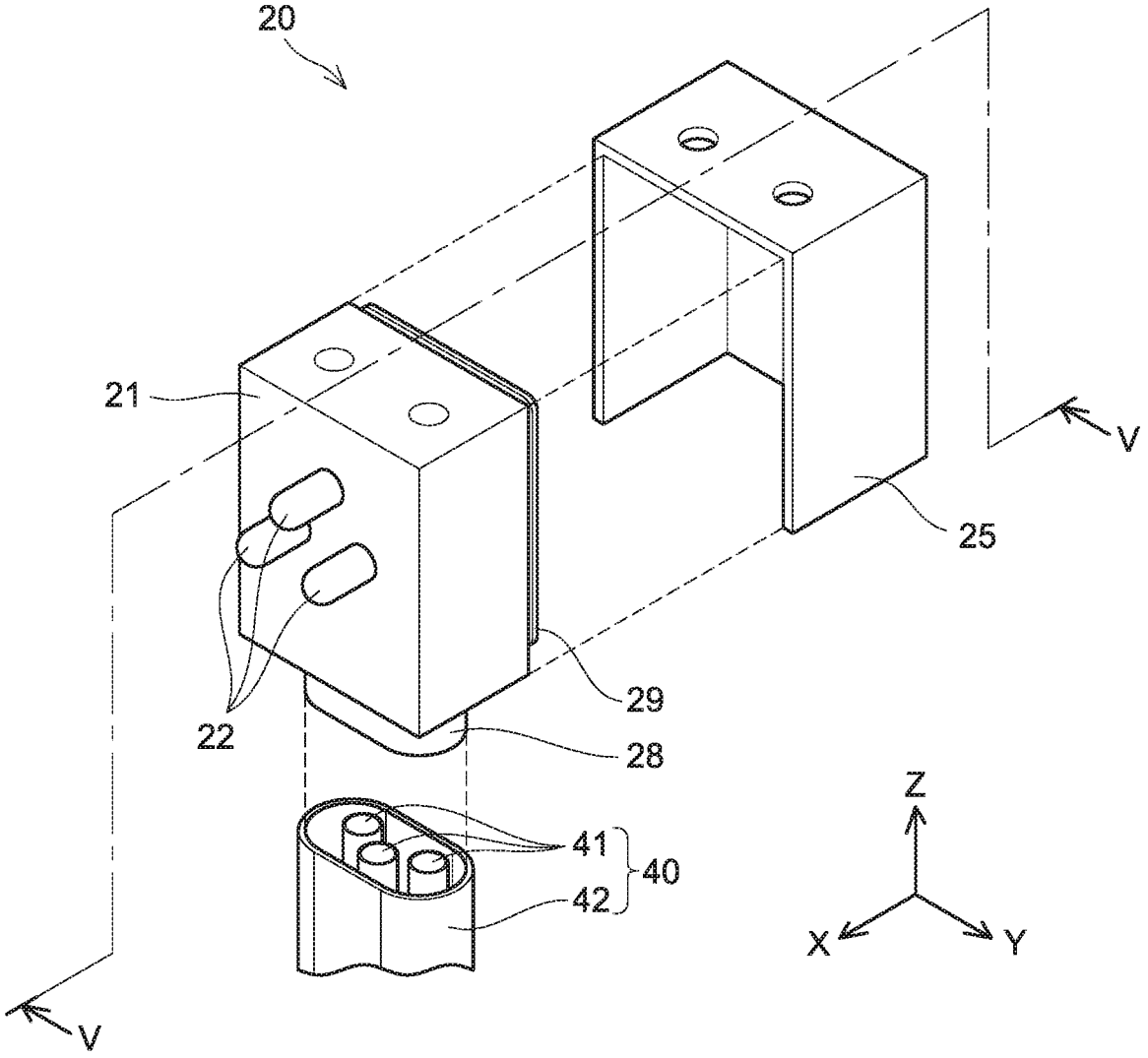
FIG. 4 is an exploded perspective view of the connector (a connector body and a lower shell are coupled).
Figure 5:
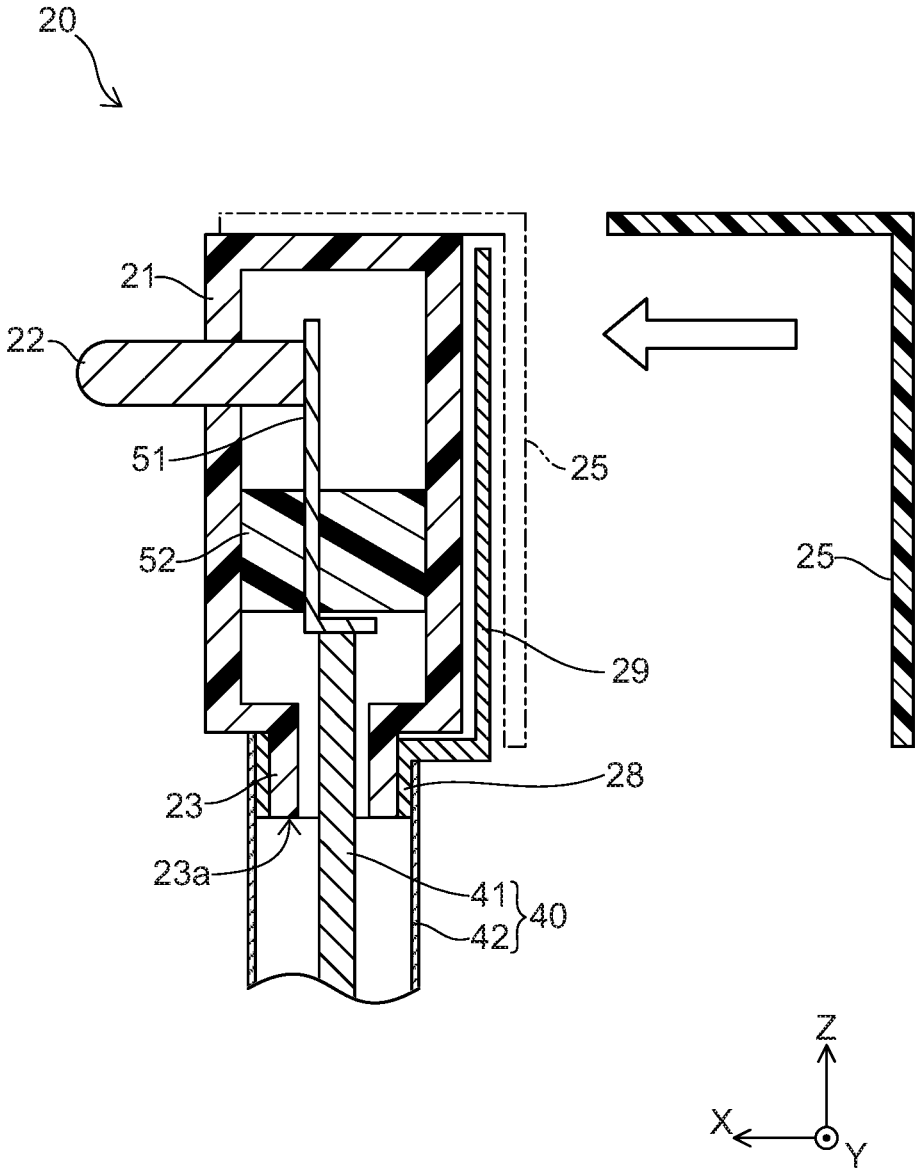
FIG. 5 is a cross-sectional view taken along a V-V line of FIG. 4.

FIG. 4 shows a perspective view in which the connector body 21 and the lower shell 28 are joined and remaining components are exploded. FIG. 5 shows a cross-sectional view along a V-V line of FIG. 4. FIG. 5 shows a state in which the connector body 21, the lower shell 28, and the wire harness 40 are joined, and only the upper shell 25 is detached from the connector body 21. The upper shell 25 attached to the connector body 21 is shown by virtual lines. Although the upper shell 25 and the connector body 21 are fixed by bolts, the bolts are not shown. As shown in FIG. 3, bolt holes 24 are provided in an upper surface of the connector body 21, and through holes 26 through which the bolts 12 (see FIG. 2) pass are provided in an upper surface of the upper shell 25. The upper shell 25 is a cover for covering a back surface of the connector body 21.

As described above, the power cables 41 of the wire harness 40 extend into the connector body 21 through a lower surface 23*a* of the connector body 21, and are electrically connected to connector terminals 22 via in-connector bus bars 51 (i.e., bus bars in the connector) shown in FIG. 5. Since the power cables 41 are three cables, three in-connector bus bars 51 are prepared, and three connector terminals 22 are also prepared. Each of the power cables 41 is connected to the corresponding one of in-connector bus bars 51 by welding, for example, and each of the in-connector bus bars 51 is also connected to the corresponding one of terminals 22 by welding, for example. Each in-connector bus bar 51 is supported by a supporting part 52 made of resin in the connector body 21.

The connector body 21 is inserted into an outlet (not shown) formed on an outer surface of the housing 11 of the power converter 10. When the connector body 21 is inserted into the outlet, the connector terminals 22 electrically connect the power cables 41 to the electric devices accommodated in the housing 11. In other words, the connector terminals 22 are electrically connected to the electrical devices accommodated in the housing 11. As described above, the wire harness 40 (three power cables 41) supplies drive power to the rear motor. More specifically, the connector terminals 22 are connected to AC output terminals of an inverter circuit inside the housing 11. The inverter circuit is a device configured to convert the DC power of the main battery into the driving power (three-phase alternating current) of the rear motor.

The driving power of the rear motor exceeds 100 volts, and a voltage exceeding 100 volts is applied to the connector terminals 22 and the in-connector bus-bars 51. When the power converter 10 subjected to the impact load from the front at the collision, the power converter 10 may be pushed backward. So, the connector 20 may come into contact with the brake actuator 91. When the connector 20 comes into contact with the brake actuator 91, it is desirable to avoid a situation in which the upper shell 25 and the connector body 21 are damaged and the connector terminals 22 and the bus-bars 51 therein are exposed.

The lower shell 28 has a ring-like shape that engages with the lower portion 23 of the connector body 21. The ring-shaped lower shell 28 has its outside to which the shield tube 42 of the wire harness 40 is jointed, and has its inside that engages with the lower portion 23 of the connector body 21. The lower shell 28 is fixed to the connector body 21 by bolts (not shown).

The guard plate 29 extends upward from the ring-shaped lower shell 28. The guard plate 29 extends between the connector body 21 and the upper shell 25. The guard plate 29 covers an entirety of a back surface of the connector body 21. The guard plate 29 is configured to protect the connector body 21 (that is, the in-connector bus-bars 51 and the connector terminals 22) from impact of collision with the brake actuator 91.

The connector body 21 is made of resin. The upper shell 25 is made of aluminum. On the other hand, the lower shell 28 is made of a metal (steel plate) for conducting with the shield tube 42. The shield tube 42 and the housing 11 are electrically connected via the conductive lower shell 28. The shield tube 42 and the housing 11 are grounded. A connection of the lower shell 28 to the housing 11 is not shown.

The guard plate 29 is integrally formed with the lower shell 28. Therefore, the guard plate 29 is also made of the steel plate. A strength of the steel plate is higher than those of aluminum and resin. Since the guard plate 29 made of the steel plate is disposed between the connector body 21 made of resin and the upper shell 25 made of aluminum, the connector 20 is robust against external impact (especially from the rear side). The lower shell 28 and the guard plate 29 are made of a metal having conductivity and high strength, such as a steel plate.

As shown in FIG. 5, the guard plate 29 extends from the lower shell 28 fixed to the lower portion 23 of the connector body 21, and is not in contact with the back surface of the connector body 21 and the upper shell 25. That is, the guard plate 29 is supported only by the lower shell 28 at its lower end, and its upper end is a free end. Since the upper end is the free end, the guard plate 29 can be deflected when its upper portion is subjected to a load. Since the guard plate 29 can be deflected, impact of a collision can be reduced.

As described above, the connector 20 of the power converter 10 is robust against impact from lateral sides (especially impact from the rear side).

Some of features of the techniques described in the embodiment will be described below. The connector 20 is connected to the rear surface 11*a* of the housing 11 of the power converter 10. The connector 20 includes the connector body 21, the upper shell 25, the lower shell 28, and the guard plate 29. The connector body 21 is made of resin and has the connector terminals 22 that are electrically connected to devices in the housing. The upper shell 25 is made of resin or aluminum, and covers the back surface of the connector body 21. The lower shell 28 is fixed to the lower portion 23 of the connector body 21. The shield tube 42 surrounding the power cables 41 is fixed to the lower shell 28. The guard plate 29 is fixed to the lower shell 28 and extends between the upper shell 25 and the connector body 21. The guard plate 29 makes the connector 20 robust. Since the guard plate 29 is disposed inside the upper shell 25, no wasted space is required outside the connector 20 to make the connector 20 robust.

The connector 20 is connected to the in-vehicle power converter 10. The power converter 10 is disposed in the front compartment 90 of the vehicle by the front bracket 93 and the rear bracket 94. The power converter 10 is supported by the transaxle 30. The power converter 10 is supported with a gap interposed between the power converter 10 and the transaxle 30. The connector 20 is connected to a surface (rear surface 11*a*) of the housing 11 that faces the rear side of the vehicle of the power converter 10. In the front compartment 90, another device (brake actuator 91) is disposed on the rear side of the connector 20. The connector 20 has the above-described features.

The techniques disclosed herein may be applied to an electrical apparatus other than power converters. The connector 20 is connected to a side surface (rear surface 11*a* of the housing 11) facing the rear side of the vehicle. In the techniques disclosed herein, the connector may be connected to any outer surface of the housing. The techniques disclosed herein may be applied to an electric vehicle other than a hybrid vehicle. The techniques disclosed herein may be applied to an electrical apparatus other than an electrical apparatus mounted on an electrical vehicle.

A cushion may be sandwiched between the guard plate 29 and the connector body 21, or between the guard plate 29 and the upper shell 25.

The connector 20 of the embodiment has three terminals (connector terminals 22), which can be referred to as a "connector 20". The connector 20 has the following features. The connector 20 includes the connector body, the upper shell, the lower shell, and the guard plate. The connector body is provided with insertion terminals. The upper shell covers the back surface of the connector body. The lower shell is fixed to the lower part of the connector body. The guard plate is fixed to the lower shell and extends between the upper shell and the connector body.

The upper shell may be made of resin or aluminum. The lower shell may be made of a metal having a higher strength than the upper shell. The guard plate may be secured only to the lower shell.

The connector disclosed herein may be attached to an end of a wire harness in which a plurality of power cables is bundled by a shield tube. Such connector is provided with a connector body to which a plurality of insertion terminals and a plurality of in-connector bus-bars (bus-bars 51 in the connector) are fixed, and the upper shell, lower shell, and guard plate described above. Each power cable is connected to corresponding one of the in-connector bus-bars (bus-bar 51 in the connector). Each in-connector bus bar is connected to corresponding one of the insertion terminals. The shield tube is electrically connected to the lower shell. The upper shell is made of resin or aluminum. The lower shell is made of a metal having a higher strength than the upper shell. The guard plate is fixed only to the lower shell.

While specific examples of the present disclosure have been described above in detail, these examples are merely illustrative and place no limitation on the scope of the patent claims. The technology described in the patent claims also encompasses various changes and modifications to the specific examples described above. The technical elements explained in the present description or drawings provide technical utility either independently or through various combinations. The present disclosure is not limited to the combinations described at the time the claims are filed. Further, the purpose of the examples illustrated by the present description or drawings is to satisfy multiple objectives simultaneously, and satisfying any one of those objectives gives technical utility to the present disclosure.

What is claimed is:

1. An electrical apparatus comprising:

a housing accommodating an electrical device; and a connector connected to an outer surface of the housing, the connector comprising:

a connector body including a terminal electrically connected to the electrical device;

an upper shell covering a back surface of the connector body;

a lower shell fixed to a lower portion of the connector body and to which a shield tube surrounding a cable connected to the terminal is fixed; and a guard plate fixed to the lower shell and extending between the upper shell and the connector body, the guard plate having an upper end and a lower end, wherein the guard plate is supported only at the lower end by the lower shell, and the upper end of the guard plate is a cantilevered, free floating free end.

2. The electrical apparatus according to claim 1, wherein the upper shell is made of resin or aluminum, and the lower shell is made of a metal having a higher strength than the upper shell.

3. The electrical apparatus according to claim 1, wherein an entirety of the upper end of the guard plate is flat.

* * * * *